United States Patent [19]

Dethlefsen

[11] 4,130,782

[45] Dec. 19, 1978

[54] HIGH VOLTAGE D-C VACUUM INTERRUPTER DEVICE WITH MAGNETIC CONTROL OF INTERRUPTER IMPEDANCE

[75] Inventor: Rolf Dethlefsen, Greensburg, Pa.

[73] Assignee: Gould Inc., Rolling Meadows, Ill.

[21] Appl. No.: 777,479

[22] Filed: Mar. 14, 1977

[51] Int. Cl.[2] ..... H01J 1/50; H01H 33/18

[52] U.S. Cl. ..... 315/335; 200/144 B; 315/338; 315/340; 315/344; 313/160; 313/162

[58] Field of Search ..... 200/144 B, 147 R, 147 B; 315/335, 338, 340, 344, 337, 62, 71; 313/160, 162

[56] References Cited

U.S. PATENT DOCUMENTS

| | | | |
|---|---|---|---|
| 2,227,829 | 1/1941 | Hansell | 315/340 X |
| 2,660,687 | 11/1953 | Coleman | 313/162 X |
| 3,696,264 | 10/1972 | Clark et al. | 313/198 X |

OTHER PUBLICATIONS

IEEE Transactions on Electron Devices, vol. BD-22, No. 4, Apr. 1975, pp. 173-180; "The Interruption of Vacuum Arcs at High DC Voltages" by Alexander S. Gilmour, Jr. & David L. Lockwood.

*Primary Examiner*—Alfred E. Smith
*Assistant Examiner*—Charles F. Roberts
*Attorney, Agent, or Firm*—Ostrolenk, Faber, Gerb & Soffen

[57] ABSTRACT

A high voltage interrupter consists of a cathode disposed centrally along the axis of an annular anode ring. The anode ring is a part of the wall of an evacuated container and is enclosed by a magnetic coil. Current flows through an arc plasma struck between the cathode and anode and this arc current is controlled by a magnetic field produced by the external coil which varies the impedance of the arc and causes the arc to extinguish. The anode contains a plurality of parallel metal vanes which extend into the interior of the evacuated housing to increase the current capability of the device and to control the rate of change of the current during switching operation.

9 Claims, 3 Drawing Figures

FIG. 1
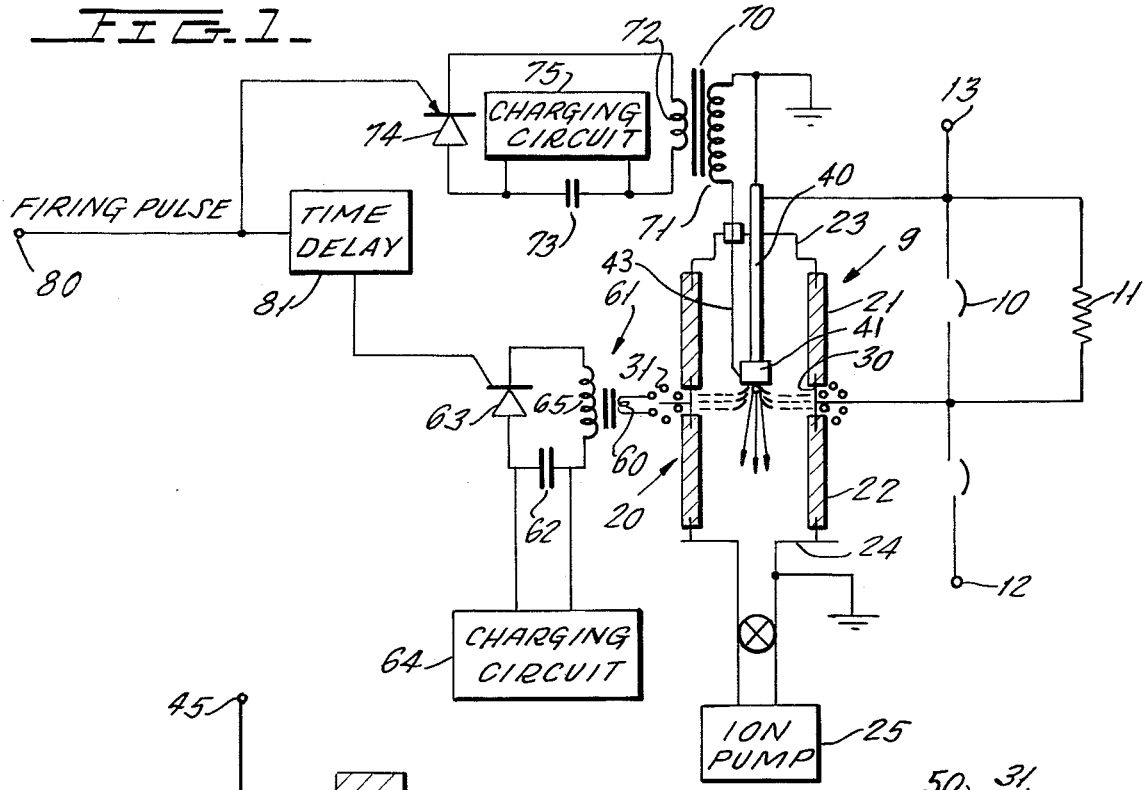
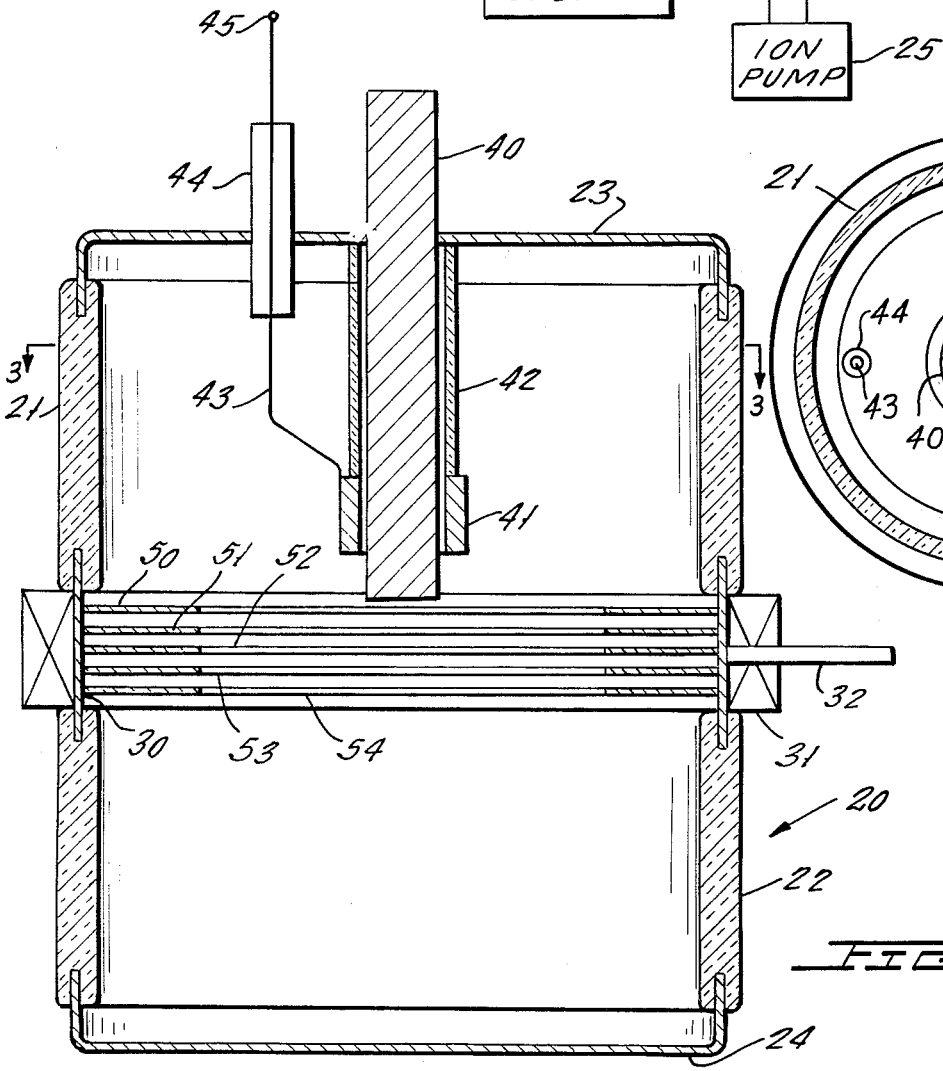
FIG. 2
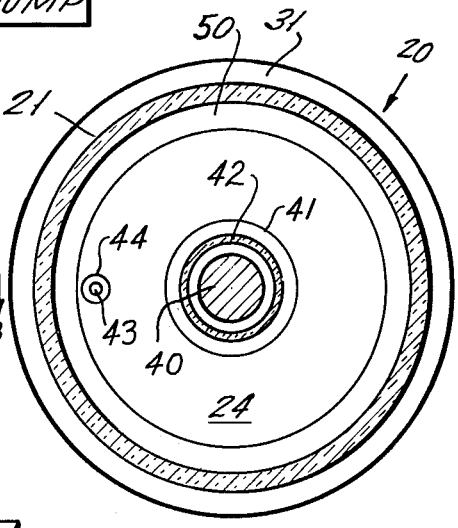
FIG. 3

HIGH VOLTAGE D-C VACUUM INTERRUPTER DEVICE WITH MAGNETIC CONTROL OF INTERRUPTER IMPEDANCE

RELATED APPLICATIONS

This application is related to copending application Ser. No. 777,453, filed Mar. 14, 1977 in the name of Rolf Dethlefsen, entitled HIGH VOLTAGE D-C VACUUM INTERRUPTER DEVICE WITH MAGNETIC CONTROL OF INTERRUPTER IMPEDANCE WITH MOVABLE CONTACT, and assigned to the assignee of the present invention.

BACKGROUND OF THE INVENTION

This invention relates to devices for switching high voltage d-c power, and more specifically relates to a novel high voltage switching device using a magnetic modulated vacuum arc discharge. Devices made in accordance with the invention have application, typically, as a transfer switching element for a fault current limiter in an a-c power transmission system, and also have application as a high voltage d-c circuit breaker, as an inverter element and as a switching element for magnetic energy storage systems.

Arrangements for switching high voltage d-c using a magnetically modulating vacuum arc discharge is known, and is described, for example, in the IEEE Transactions on Electron Devices, Volume ED-22, No. 4, April 1975, pages 173 to 180 in a paper entitled THE INTERRUPTION OF VACUUM ARCS AT HIGH DC VOLTAGES, by Alexander S. Gilmour, Jr. and David L. Lockwood. Such devices are also described in U.S. Pat. No. 3,696,264, dated Oct. 3, 1972 in the name of Clark et al. In the arrangement shown in the above paper, a cathode is disposed on the axis of a ring-shaped anode element. The anode is surrounded by a magnetic field-producing coil. This entire assemblage is then mounted within a vacuum container. The paper suggests that it might be possible to put the coil outside of the vacuum envelope. The cathode serves as a source of electrons which flow to the surrounding anode. The arc current is controlled and extinguished by producing a magnetic field from the coil, which magnetic field passes through the arc path. The magnetic field is produced by current through the coil. The duration and amplitude of the magnetic field can then be controlled sufficiently to cause extinction of arc current flow. When arc conduction ceases, the metal vapor from the cathode which provided the arc current medium rapidly condenses and the circuit between the device terminals is opened. Experimental devices have been built with the capability to interrupt a direct current of 800 amperes at 25 kV and 8 kA at a recovery voltage of 8 kV. These parameters were determined by the experimental setup. Higher capability is possible, depending on the component design.

The arrangement shown in the paper by Gilmour et al has several shortcomings which would prevent its use as a commercial device. For example, in order to make connection to the anode in Gilmour's arrangement, it is necessary to provide high voltage vacuum feed-through terminals which pass through the vacuum container and are connected to the anode ring. These high voltage feed-throughs are particularly troublesome components and are a source of frequent failure.

Another difficulty in the arrangement proposed by Gilmour et al is that the power for the magnetic control field is supplied from a power supply with an electronically controlled time delay or by an anode coil in which the discharge current produces a magnetic field essentially without time delay. When this device is to be applied as a fault current limiter switching element, a controlled time delay is needed for the magnetic field with respect to the arc discharge current. The present invention provides a novel arrangement consisting of radially disposed metal plates enclosed by the anode for delaying the magnetic field buildup through the design of the anode, thus eliminating the need for a separate power supply and electronics for producing the magnetic field.

A further difficulty with the device proposed by Gilmour et al is that the rate of change of current during switching is extremely high so that the device will generate extensive surge voltages in inductive networks.

BRIEF DESCRIPTION OF THE PRESENT INVENTION

In accordance with the present invention, a novel switching device using a magnetically modulated vacuum arc discharge is provided, wherein the anode ring is made an integral part of the enclosure. The anode ring may have metallic baffles extending from its interior diameter into the interior of the vacuum container. By making the anode an integral part of the envelope wall, direct connection can be made to the anode without the need for feed-through seals for the device terminals. The use of the anode as a part of the container wall also simplifies the problem of removing heat from the anode.

The externally available anode is then surrounded by an external magnetic coil which is arranged to generate a magnetic field which will diffuse through the anode metal into the space between the electrodes within the evacuated container. The diffusion of the magnetic field is delayed in time as a function of the anode thickness and its material properties according to the relationship:

$$\tau = \mu d^2 \sigma$$

where:

$\tau$ is the time delay of the magnetic pulse traveling through the anode metal;

$\mu$ is the magnetic permeability of the anode material;

d is the thickness of the anode wall; and $\sigma$ is the electrical conductivity of the anode wall.

When using a 3 millimeter thick copper anode electrode, the time delay will be about 0.66 milliseconds.

When the device of the invention is used as the switching device of a fault current limiter, time delays of from 0.1 to about 1.0 milliseconds are needed. These delays can be obtained with the present invention by using appropriate anode material thicknesses. Time delay control can also be obtained through the selection of appropriate anode materials which will have the desired electrical conductivity and magnetic permeability and would include materials such as stainless steel, iron, refractories and the like. It is also possible to choose a ferromagnetic material which will have the property of magnetically saturating, thereby to permit a very sudden appearance of the magnetic field in the interelectrode space once the dischrge current exceeds a certain threshold value.

In accordance with a further feature of the invention, spaced, flat metal vanes are disposed on the inner diameter of the anode, which vanes increase the anode area and thus the current capability of a given design. The vanes also reduce the rate of change of current during switching. Thus, the use of metal vanes will cause the magnetic field to diffuse radially inwardly toward the arcing space at a finite speed. As this occurs, the area of current attachment of the arc to the anode will progressively become smaller. Thus, the magnetic field moving radially inwardly will, in effect, sweep the current off the vanes at a controlled rate. This action is useful since the magnetic field can be sustained for some time after anode current begins to reduce because of induced currents which appear in the anode and in the metal vanes. This delay permits the connection of the magnetic field coil in series with the vacuum arc, and simplifies the circuit needed to energize the coil.

BRIEF DESCRIPTION OF THE DRAWINGS

FIG. 1 schematically illustrates a circuit diagram of one embodiment of the switching device of the present invention.

FIG. 2 is a cross-sectional view taken through the axis of an embodiment of the vacuum device constructed in accordance with the present invention.

FIG. 3 is a cross-sectional view of FIG. 2 taken across the section line 3—3 in FIG. 2.

DETAILED DESCRIPTION OF THE DRAWINGS

Referring now to the figures, the novel interrupter of the device is illustrated in FIG. 1 as a fault current limiter which is operable with a fast-acting circuit interrupter or switching device 10 to transfer the flow of power into the vacuum device 9 and from there into resistor 11. The fastacting mechanical switch 10 may also be incorporated into the vacuum envelope of the magnetically controlled switching device. The parallel-connected switch 10, vacuum device 9 and resistor 11 may be connected in a power-carrying circuit having terminals 12 and 13. Note that the system of FIG. 1 would normally be a multiphase system and only one of the phases is shown.

The schematically illustrated interrupter of FIG. 1 is shown in more detail in FIGS. 2 and 3. The magnetically controlled vacuum interrupter 20 has a vacuum container which is comprised of insulation rings 21 and 22 which have end plates 23 and 24, respectively, secured to the insulators 21 and 22 in any desired manner. The insulators 21 and 22 may be of glass or ceramic or of any other desired material.

FIG. 1 illustrates the permanent connection of an ion pump 25 to the interior of the container through a valve 26. In the embodiment of FIGS. 2 and 3, the interior of the container is permanently evacuated but means can be provided for communicating an ion pump to the container if necessary.

The opposing ends of insulation rings 21 and 22 are connected to one another through a metal anode ring 30 which also serves as the anode of the interrupter. The anode ring 30, in accordance with the invention, comprises a portion of the wall of the housing and consists of that portion of the wall extending between the insulators 21 and 22. Anode ring 30 may be of stainless steel, Kovar or copper having a thickness in the order of millimeters (typically 3 millimeters) and a length in the order of centimeters (typically about 5 centimeters). The anode ring 30 is gas-impervious (as are all of the container seals) and is capable of maintaining the evacuated condition of the interior of the container of the figures.

The external diameter of anode ring 30 receives a magnetic field coil 31. Coil 31 can, for example, be a six-turn coil which will have the function to be hereinafter described. An anode connector 32, which is connected to the anode 30 at an external surface thereof, passes through and is insulated from winding 31.

The end plate 23 receives a cathode electrode 40 which has a portion thereof extending beyond and above the end plate 23 to serve as a terminal or cathode connection region, and cathode 40 is surrounded by an igniter electrode 41. The igniter electrode 41 is spaced from the cathode 40 and is held in position by an insulation sleeve 42. A lead 43, connected to the igniter electrode 41, is taken out through the lead-through structure 44 to define a trigger electrode 45, available externally of the container in FIG. 2.

As further shown in FIGS. 2 and 3, a plurality of spaced, flat metal baffle plates 50 to 54 are disposed perpendicularly to the axis of the container in FIGS. 2 and 3 and project inwardly toward the axis of the container. The function of these baffle plates will be later described.

FIG. 1 illustrates the manner in which control circuits are connected to the interrupter of FIGS. 2 and 3. Thus, winding 31 has its opposite end connected to the secondary winding 60 of a pulse transformer 61. The primary winding 65 of the pulse transformer 61 is then connected in closed series relationship with an energy storage capacitor 62 and controlled rectifier 63. The energy storage capacitor 62 is connected to a suitable charging circuit 64.

A second pulse transformer 70 is provided with a secondary winding 71 connected between igniter electrode 41 and cathode 40 and its primary winding 72 is connected in closed series with energy storage capacitor 73 and controlled rectifier 74. A suitable charging circuit 75 is connected to the capacitor 73.

The gate electrode of controlled rectifiers 63 and 74 is then energized from the same firing pulse source connected to electrode 80, but a time delay circuit 81 is connected between the firing pulse electrode 80 and the gate of controlled rectifier 63. Consequently, when a firing pulse is produced at terminal 80, the controlled rectifier 74 turns on and charged capacitor 73 discharges into primary winding 72 to produce a strong voltage pulse between igniter electrode 41 and cathode 40. At this time, a small coating or film of metal extends between igniter 41 and cathode 40 and this film is rapidly vaporized to produce an initial arc which is rapidly transferred from the cathode 40 to the anode 30. The interrupter 10 has opened prior to the triggering pulse such that sufficient voltage units, say 3000 volts, to start the vaccum arc. As interrupter 10 of FIG. 1 opens, current will begin to transfer from the main path of interrupter 10 into the vacuum interrupter device, with this current flowing in the arc between anode 30 and cathode 40.

After a given time delay, as determined by the time delay circuit 81, the controlled rectifier 63 is fired and capacitor 62 discharges into primary winding 65, where the voltage is stepped down and applied to the winding 60. This pulse will produce a magnetic field pulse which may typically rise to a value of 400 gauss and, as the magnetic field of winding 31 increases in the interelectrode arcing space, the arc impedance increases dramatically to exert a current limiting action on the current in the arc. As the magnetic field increases, the arc is ultimately extinguished, thereby to transfer the arc into the parallel resistor 11 for the purpose of fault current limitation.

After the arc is extinguished, the metal vapors within the container condense to again re-establish the metal film between igniter 41 and cathode 40 so that the device is ready for its next operation.

It will be understood that, by manufacturing the device with the anode 30 as an integral part of the container wall, it is now possible to make direct connection to the anode (through anode connector 32) without having to penetrate the container. Moreover, the connections to the winding 31 are made externally of the housing and there is no need to penetrate the housing wall to make connection to winding 31.

It will be further noted from FIG. 1 that the same source of power used for the firing pulse which is produced at terminal 80 also causes ignition of the initial arc in order to turn the device on and later produces the magnetic field for extinguishing vacuum arc current after the conventional switching device 10 is opened.

Any type of arc trigger mechanism can be used in accordance with the present invention. Thus, arc triggering can be obtained by the separation of a current carrying contact as, for example, in the manner disclosed in copending application Ser. No. 777,453, referred to previously.

During the operation of the device, the arc voltage between the cathode 40 and anode 30 will be between 20 and 200 volts. The magnetic field produced by coil 31, which is delayed until the time arrives for switching off the current, produces a greatly increased arc voltage and high frequency oscillations are generated within the arc plasma by the field. The arc current can be reduced until the current flow stops, followed by dielectric recovery of the vacuum switching device.

In order to reduce the rate of change of current in the arc and thus to reduce the resulting voltage surges in an inductive circuit, a plurality of metal vanes 50 to 54 are provided on the anode 30. These metal vanes serve two purposes. The first is that they increase the effective anode area to increase the current capability of the device. The second function of these vanes is to control (and reduce) the switching rate of change of current since the magnetic field produced by winding 30 will diffuse radially inwardly through the metal vanes 50 to 54 at a finite speed. As the magnetic field proceeds inwardly, it will sweep current off of the metal vanes at a controlled rate. The magnetic field can be sustained for a significant time period after the anode current begins to drop. This is a very useful operation if the device of the invention generates the magnetic control field by connecting coil 31 in series with the anode connection 32 such that the arc current flows through coil 31, replacing separate power supply 60 to 65 and time delay circuit 81.

In one embodiment of the invention, each of vanes 50, 51, 52, 53 and 54 had a outer diameter of about 20 cm and an inner diameter of about 15 cm. The vanes were then spaced from one another by about ¼ inch and each was formed of iron having a thickness of about ½ millimeter.

Although a preferred embodiment of this invention has been described, many variations and modifications will now be apparent to those skilled in the art, and it is therefore preferred that the instant invention be limited not by the specific disclosure herein but only by the appended claims.

The embodiments of the invention in which an exclusive privilege or property is claimed are defined as follows:

1. A current-limiting device comprising, in combination:

an evacuated container having a cylindrical wall having first and second ends and first and second terminals accessible externally of said container;

a cathode electrode disposed within said container and located generally along the axis of said container and connected to said first terminal;

an anode electrode comprising a ring-shaped member insulated from said cathode electrode; said anode electrode comprising a portion of said cylindrical wall and connected to said second terminal; said anode electrode coaxially surrounding said cathode electrode and being disposed between and spaced from each of said first and second ends of said cylindrical wall;

a winding wound around the outer diameter of said anode electrode;

said current-limiting device being operable to carry current through an arc drawn between said cathode electrode and said anode electrode; said winding being operable to produce a magnetic field which extends through said arc in order to increase the electrical impedance of said arc, and to extinguish said arc;

triggering circuit means connected to said cathode electrode for producing an initial arc plasma which is subsequently transferred to said anode electrode;

and a time delay circuit connecting said triggering circuit means to said winding, whereby a magnetic field pulse is appied to the interelectrode space between said cathode and anode electrodes with a given time delay.

2. The current-limiting device of claim 1 which further includes a current-limiting resistor connected across said first and second terminals.

3. The device of claim 1 which further includes a plurality of axially spaced, parallel, flat metallic baffles each connected directly to the inner diameter of said anode electrode and each extending from said inner diameter of said anode electrode and toward the axis of said container.

4. The current-limiting device of claim 3 which further includes a current-limiting resistor connected across said first and second terminals.

5. A current-limiting device comprising, in combination:

an evacuated container having a cylindrical wall having first and second ends and first and second terminals accessible externally of said container;

a cathode electrode disposed within said container and located generally along the axis of said container and connected to said first terminal;

an anode electrode comprising a ring-shaped member insulated from said cathode electrode and connected to said second terminal; said anode electrode coaxially surrounding said cathode electrode and being disposed between and spaced from each of said first and second ends of said cylindrical wall;

a winding wound around the outer diameter of said anode electrode;

said current-limiting device being operable to carry current through an arc drawn between said cathode electrode and said anode electrode; said winding being operable to produce a magnetic field which extends through said arc in order to increase the electrical impedance of said arc, and to extinguish said arc; and at least three axially spaced, parallel, flat metallic baffles each connected directly to the inner diameter of said anode electrode and each extending from said inner diameter of said anode electrode and toward the axis of said container.

6. The current-limiting device of claim 5 which further includes a current-limiting resistor connected across said first and second terminals.

7. The device of claim 5 which further includes a firing circuit connected to said cathode electrode for producing an initial arc plasma which is subsequently transferred to said anode electrode, and a time delay circuit connecting said firing circuit to said winding, whereby a magnetic field pulse is applied to the interelectrode space between said cathode and anode electrodes with a given time delay.

8. A current-limiting device comprising, in combination:

an evacuated container having a cylindrical wall and first and second electrodes accessible externally of said container;

a cathode electrode disposed within said container and located generally along the axis of said container;

an anode electrode comprising a ring-shaped member insulated from said cathode electrode; said anode electrode coaxially surrounding said cathode electrode;

a winding wound around the outer diameter of said anode electrode;

said current-limiting device being operable to carry current through an arc drawn between said cathode electrode and said anode electrode; said winding being operable to produce a magnetic field which extends through said arc in order to increase the electrical impedance of said arc, and to extinguish said arc; and a firing circuit connected to said cathode electrode for producing an initial arc plasma which is subsequently transferred to said anode electrode, and a time delay circuit connecting said firing circuit to said winding, whereby a magnetic field pulse is applied to the interelectrode space between said cathode and anode electrodes with a given time delay.

9. The device of claim 8 which further includes a plurality of axially spaced, parallel, flat metallic baffles extending from the inner diameter of said anode electrode and toward the axis of said container.

* * * * *